United States Patent [19]

McConaghy et al.

[11] 4,332,641

[45] Jun. 1, 1982

[54] PROCESS FOR PRODUCING CALCINED COKE AND RICH SYNTHESIS GAS

[75] Inventors: James R. McConaghy; Ardis L. Anderson, both of Ponca City, Okla.

[73] Assignee: Conoco, Inc., Ponca City, Okla.

[21] Appl. No.: 219,007

[22] Filed: Dec. 22, 1980

[51] Int. Cl.[3] ..... C10B 49/06; C10J 3/66; C10J 3/68; C10J 3/82

[52] U.S. Cl. ..... 201/17; 48/197 R; 201/34; 201/38

[58] Field of Search ..... 201/16, 11, 34, 38, 201/25; 48/197 R, 202; 252/373

[56] References Cited

U.S. PATENT DOCUMENTS

| | | | |
|---|---|---|---|
| 2,561,419 | 7/1951 | Schutte | 48/197 R |
| 2,605,215 | 7/1952 | Coghlan | 201/16 |
| 2,634,198 | 4/1953 | Kalbach | 201/16 |
| 2,662,006 | 12/1953 | Eastwood | 48/197 R |
| 3,088,816 | 5/1963 | Huntington | 48/197 R |
| 3,107,985 | 10/1963 | Huntington | 48/197 R |
| 3,573,224 | 3/1971 | Strelzoff et al. | 48/197 R |
| 3,676,517 | 7/1972 | Merrill, Jr. et al. . | |
| 3,920,417 | 11/1975 | Fernandes . | |
| 4,007,092 | 2/1977 | Metrailer et al. . | |
| 4,251,323 | 2/1981 | Smith | 201/29 |

*Primary Examiner*—Bradley Garris
*Attorney, Agent, or Firm*—Richard W. Collins

[57] ABSTRACT

Carbonaceous material such as petroleum coke is calcined in the upper part of an air-injected vertical shaft kiln, and steam injected into the lower part of the kiln reacts with hot coke below the combustion zone to produce hydrogen and carbon monoxide. A product gas stream rich in hydrogen and low in nitrogen is withdrawn from a level below the combustion zone in the kiln. High sulfur coke can be desulfurized in the process by maintaining the temperature in the calcining zone above 1400° C.

4 Claims, 1 Drawing Figure

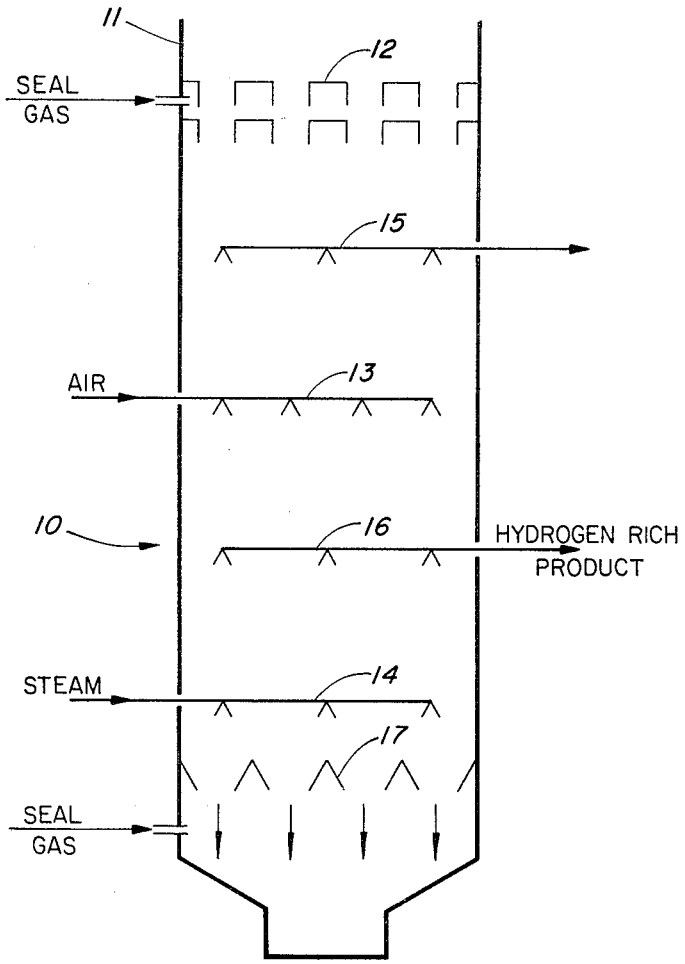
11
12
SEAL
GAS
15
AIR
13
10
16
HYDROGEN RICH
PRODUCT
STEAM
14
17
SEAL
GAS

PROCESS FOR PRODUCING CALCINED COKE AND RICH SYNTHESIS GAS

BACKGROUND OF THE INVENTION

This invention relates to calcining of carbonaceous material such as petroleum coke, and more particularly to production of a hydrogen-rich product gas stream in a vertical shaft kiln.

Calcination of carbonaceous material such as petroleum coke is carried out routinely. It is known that by maintaining a calcining temperature above about 1400° C. much of the sulfur in the material being calcined can be removed. Such calcination is usually carried out in large inclined rotary kilns. A process for calcining petroleum coke in a moving bed vertical shaft kiln is described in U.S. application Ser. No. 30,251, now U.S. Pat. No. 4,251,323 filed Apr. 16, 1979 by John H. Smith and assigned to the assignee of this application.

It is also well known that hot carbon (above about 315° C.) and steam react according to the water gas reaction $C+H_2O \rightleftarrows H_2+CO$. This reaction is the basis of much of the effort to gasify coal or other carbonaceous material. A typical gasification process is described in U.S. Pat. No. 3,920,417. That patent describes a process wherein coal is fed to a moving bed retort, oxidizing gas is injected to burn a portion of the coal and heat the remainder, and steam is injected below the ignition level to produce the desired reaction. Product gas is removed from the bottom of the retort.

U.S. Pat. No. 4,007,092 describes a fluid coking and gasification process in which an oxygen-containing gas is introduced into the upper portion of the gasification zone and steam is introduced into the lower portion of the gasification zone.

Both of the processes described in the aforementioned patents are subject to a common deficiency. If air is used as the oxidizing gas, the product gas is heavily diluted with nitrogen. Nitrogen is difficult to remove from the product stream, and if not removed, drastically reduces the heating value per unit volume of the product gas. If the nitrogen dilution problem is avoided by using pure oxygen as the oxidizing gas, then an expensive air separation facility must be provided.

A process of calcining coke and producing synthesis gas is described in U.S. Pat. No. 3,676,517. Again, the process described results in the synthesis gas being diluted with nitrogen when air is used to oxidize coke in the calciner.

There has been a continuing need for a process that could produce a high heating value gas from a gasification process which could utilize air as the oxidizing medium. Such a process is provided by the present invention.

SUMMARY OF THE INVENTION

According to the present invention, carbonaceous material is fed to a moving bed vertical shaft kiln, air is injected to provide a combustion zone in the kiln, steam is injected into the lower part of the kiln to produce hydrogen and carbon monoxide by reaction with hot carbon, and a product gas having a high hydrogen content and low nitrogen content is withdrawn from the kiln below the combustion zone. The gas flow throughout the kiln is upward, preventing nitrogen in the injected air from diluting the product gas which is withdrawn below the air injection level.

Thus, a gasification process is provided which allows use of ordinary air as the oxidizer without the resultant drawback of producing a nitrogen-diluted product gas stream.

BRIEF DESCRIPTION OF THE DRAWINGS

The FIGURE is a schematic cross section of a shaft kiln adapted to carry out the invention.

DESCRIPTION OF THE PREFERRED EMBODIMENT

The process of this invention is applicable to particulate carbonaceous material, and particularly to petroleum coke, either from the delayed coking process or the fluid bed process. The process has particular advantages when the coke has a high sulfur content, such as greater than 2 percent by weight.

The process of the invention provides the capability of producing a low sulfur calcined coke and a gas product undiluted with nitrogen utilizing a high sulfur coke, air and steam.

It is well known that calcining high sulfur coke at temperatures of from 1400° to 1600° C. greatly reduces the sulfur content of the coke.

The equipment used in the process is in general conventional, and can be similar to that described in U.S. Application Ser. No. 30,251 referred to above. However, the kiln for this process must have provision for injecting steam into the lower section and for withdrawing product gas below the air injection level.

As shown in the drawing, a vertical shaft kiln 10 is provided with an upper receiving hopper 11 and distribution members 12 for uniformly feeding particulate carbonaceous material. An air distributor 13 is provided near the midpoint of kiln 10, and a steam distributor 14 is provided near the bottom of kiln 10. An upper gas draw 15 is provided near the top of the kiln to remove products of combustion along with vaporized moisture and volatile matter from the coke. In the case of a high sulfur feed, hydrogen sulfide will be removed from gas draw 15 if the calcining temperature is maintained above about 1400° C.

An intermediate gas draw 16 is provided below the level of air distributor 13 for removing gaseous products of the reaction $C+H_2O \rightleftarrows H_2+CO$ which takes place in the lower part of the kiln. Through proper regulation of the various gas distributors and gas draws and use of mechanical seals or seal gas at each end of the kiln, the gas flow throughout the kiln is from bottom to top. Some of the gas from the lower portion of the kiln travels past gas draw 16 to the combustion zone. Calcined product is removed through lower distributors 17.

Since gas draw 16 is below air distributor 13 and since gas flow is upward through the kiln, it will be apparent that the gas removed from gas draw 16 will be essentially nitrogen-free. The product gas can be used as a fuel gas, or it can be processed to provide an enriched hydrogen stream. Either the raw product gas or the enriched hydrogen stream can be used for the catalytic hydrodesulfurization of liquid hydrocarbons.

Operation of the process utilizing a green delayed petroleum coke containing 10 percent by weight sulfur will now be described.

Green coke is introduced to the top of kiln 10. The rate of green coke feed is controlled by the rate of withdrawal of calcined coke from the bottom of the kiln. The coke is maintained at a temperature of from 1400° to 1600° C. in the upper calcining section of the kiln for a time sufficient to calcine and desulfurize the coke to about a 1 percent by weight sulfur level. Nitrogen, combustion products, hydrogen sufide and volatile material from the coke are removed through upper gas draw 15. The hydrogen sulfide can be removed and converted to elemental sulfur in a conventional manner.

Hot calcined coke descends past air distributor 13 and gas draw 16 where it reacts with steam to produce primarily hydrogen and carbon monoxide. From 5 to 25 percent by weight of the carbon in the coke, and typically about 15 percent, will react with the steam by the reaction $C+H_2O \rightleftarrows CO+H_2$ in a single pass. The unreacted coke is cooled by the steam and removed as a calcined low-sulfur coke product.

Products of the steam-coke reaction are removed through product gas draw 16.

A typical gas product stream would have the composition set forth in Table I.

TABLE I

| Component | Volume Percent |
|---|---|
| $H_2$ | 55 |
| CO | 38 |
| $CH_4$ | 1 |
| $CO_2$ | 6 |
| $H_2S$ | nil |
| $N_2$ | nil |

Thus, even though air is used as the oxidizing gas to the process, the product gas is nitrogen-free, providing an undiluted fuel gas having a higher heating value than is obtained in conventional gasification reactions when air is used as the oxidant.

The process as described above would also apply where the feed is a high sulfur petroleum coke produced by the fluidized bed process.

What is claimed is:

1. A method of calcining green petroleum coke to produce calcined coke and a gas stream which is high in hydrogen content and low in nitrogen content consisting essentially of the steps of:

(a) feeding particulate green petroleum coke into the top of a vertical shaft kiln to provide a downwardly moving bed of coke in the kiln;

(b) injecting combustion air into an intermediate combustion zone of the kiln to provide a calcining section at a temperature of from 1400° to 1600° C.;

(c) recovering internally-generated flue gas including nitrogen from said combustion air from the upper section of the kiln;

(d) introducing steam into the lower section of the kiln whereby the steam contacts hot coke descending from the combustion zone and reacts therewith according to the reaction $C+H_2O \rightleftarrows H_2+CO$ to produce hydrogen and carbon monoxide;

(e) maintaining an upward flow of gas throughout said kiln;

(f) recovering calcined coke product from the operation; and (g) withdrawing a gas stream comprised of hydrogen and carbon monoxide from a level in the kiln below the combustion zone and above the steam injection level, thereby producing a product gas stream rich in hydrogen and substantially free of nitrogen.

2. The method of claim 1 wherein the petroleum coke is green delayed coke.

3. The method of claim 1 wherein the petroleum coke is fluidized bed coke.

4. The method of claim 1 wherein the petroleum coke is a high sulfur coke.

* * * * *